US005742963A

United States Patent [19]

Trevino et al.

[11] Patent Number: 5,742,963

[45] Date of Patent: Apr. 28, 1998

[54] PATIENT SUPPORT APPARATUS

[76] Inventors: John Trevino, 129 Acacia, Biloxoi, Miss. 39530; Scott Allen Froboese, 3410 A Ave., Gulfport, Miss. 39507

[21] Appl. No.: 779,927

[22] Filed: Jan. 6, 1997

[51] Int. Cl.[6] ..... A61G 7/06

[52] U.S. Cl. ..... 5/632; 5/646; 5/648; 5/655.9; 5/657; 128/845

[58] Field of Search ..... 5/630, 632, 646, 5/648, 694, 722, 723, 731, 732, 733, 734, 740, 655, 655.9, 657, 900.5, 922, 625, 628; 128/845, 846, 870

[56] References Cited

U.S. PATENT DOCUMENTS

| | | | |
|---|---|---|---|
| 3,110,042 | 11/1963 | Slemmons | 5/345 |
| 3,156,500 | 11/1964 | Kerr | 297/391 |
| 4,631,766 | 12/1986 | Semmler et al. | 5/655 |
| 4,665,573 | 5/1987 | Fiore | 5/900.5 X |
| 4,730,801 | 3/1988 | Cloward | 5/648 X |
| 4,794,657 | 1/1989 | Avery | 5/431 |
| 4,802,249 | 2/1989 | Bills | 5/420 |
| 4,805,603 | 2/1989 | Cumberland | 128/75 |
| 4,893,367 | 1/1990 | Heimreid et al. | 5/431 |
| 4,907,308 | 3/1990 | Leininger et al. | 5/455 |
| 4,918,774 | 4/1990 | Popitz | 5/441 |
| 5,014,375 | 5/1991 | Coonrad et al. | 5/648 |
| 5,034,594 | 7/1991 | Beezhold et al. | 219/533 |
| 5,054,142 | 10/1991 | Owens | 5/722 X |
| 5,163,194 | 11/1992 | Dixon | 5/636 |
| 5,224,226 | 7/1993 | Groenewald | 5/481 |
| 5,279,310 | 1/1994 | Hsien | 128/845 |
| 5,307,532 | 5/1994 | Connell | 5/643 |
| 5,400,449 | 3/1995 | Satto | 5/632 X |
| 5,584,303 | 12/1996 | Walle | 5/648 X |

*Primary Examiner*—Michael F. Trettel
*Attorney, Agent, or Firm*—Pravel, Hewitt, Kimball & Krieger

[57] ABSTRACT

A patient support apparatus which includes a firm body support portion constructed of foam, with the foam having a first side for placement on a bed or gurney, and the second side upon which the body of the patient would be laid. The foam apparatus would include a principal upper torso support portion for supporting a patient generally from the top of the patient's head to the lower buttock region of the patient; first and second leg portions which are attachable to a lower edge of the principal body support portion for supporting the legs of the patient, and attachable arm portions secured to the side edges of the upper body support portion for accommodating the arms of the patient. The upper sides of the principal body portion, leg portions and arm portions would further include contoured regions which would reflect the general shape of the patient as the patient is laid on the patient's back on the apparatus, and would provide a soft yet firm support for the patient along the entire body region of the patient during transport. It is foreseen that in other embodiments, the apparatus may include a generally principal body support portion for supporting, for example, an infant in the support portion, which would support the entire length of the infant. Further, it is foreseen that the apparatus may be utilized in its separate components, depending on the extent of injury to the person being transported. Furthermore, other embodiments may include pockets formed within the principal body portion for inserting heating pads or other types of materials so that the patient may receive some form of treatment during transport or while the person is housed within an emergency medical facility awaiting treatment or is under specialized care.

15 Claims, 6 Drawing Sheets

PATIENT SUPPORT APPARATUS

BACKGROUND OF THE INVENTION

1. Field of the Invention

The apparatus of the present invention relates to supporting a patient in a prone position. More particularly, the present invention relates to a foam support apparatus which will support a patient along the entire body of the patient, or the upper torso or certain limbs of the patient, through a support system which includes removable contoured support components.

2. General Background of the Invention

In the art of patient care, one of the most difficult areas in caring for patients is the ability to make a patient comfortable and not at risk, particularly while the patient is being transported from the patient's home or the scene of an accident, to a hospital for managed care. In the present state of the art, patients who must receive emergency care and must require transport to a hospital or clinic in emergency response vehicles such as ambulances, fire teams, helicopters, or the like, are usually placed upon a gurney of some sort having a pad, such as a thin mattress, upon which the patient lies while the gurney is being carried by individuals and then later moved into the vehicle for transport. It is quite common that the ride between the scene of the accident or the patient's home to the medical facility is quite lengthy, often times requiring that the vehicles travel over very difficult roads, which may be very harmful, if not ultimately fatal to a patient in dire need. Often, it is the case that a patient who is in critical care and on life support, during transport, would require a much more stable and smooth ride to the medical facility in order to survive during this critical time.

Furthermore, even while the patient is resting at the hospital or medical care facility, it is required that the patient often times be supported on a very specialized type of bedding or the like, so that the patient's needs are met. Often times, such a type of support for the patient's body or upper torso or limbs is not available, and therefore the patient must suffer due to this lack of specialized bedding. Therefore, there is a need in the industry for addressing the transport of the critically ill or injured, particularly, in emergency response vehicles, in such a manner that the person who is injured or ill is supported in his most comfortable and secure setting, and that while he is in transport, that no further injury occurs to the patient because of the difficult ride. There have been patents cited in the art which attempt to address certain aspects of the problems which are confronted in the art, and these are incorporated into the prior art statement which is being filed simultaneously herewith.

BRIEF SUMMARY OF THE INVENTION

The apparatus of the present invention solves the problems in the art in a simple and straightforward manner. What is provided is a patient support apparatus which includes a firm body support portion constructed of foam, with the foam having a first side for placement on a bed or gurney, and the second side upon which the body of the patient would be laid. The foam apparatus would include a principal upper torso support portion for supporting a patient generally from the top of the patient's head to the lower buttock region of the patient; first and second leg portions which are attachable to a lower edge of the principal body support portion for supporting the legs of the patient, and attachable arm portions secured to the side edges of the upper body support portion. for accommodating the arms of the patient. The upper sides of the principal body portion, leg portions and arm portions would further include contoured regions which would reflect the general shape of the patient as the patient is laid on the patient's back on the apparatus, and would provide a soft yet firm support for the patient along the entire body region of the patient during transport. It is foreseen that in other embodiments, the apparatus may include a generally principal body support portion for supporting, for example, an infant in the support portion, which would support the entire length of the infant.

Further, it is foreseen that the apparatus may be utilized in its separate components, depending on the extent of injury to the person being transported.

Furthermore, other embodiments may include pockets formed within the principal body portion for inserting heating pads, gel packs, or other types of materials so that the patient may receive some form of treatment during transport or while the person is housed within an emergency medical facility awaiting treatment or is under specialized care.

Therefore, it is the principal object of the present invention to provide a foam patient support apparatus which would support the entire body portion of the patient, while the patient is being transported or in emergency care;

It is a further object of the present invention to provide a foam patient support apparatus which is able to be assembled into individual components and when fully assembled, define support for the entire body yet when disassembled in certain formations, provide for support for only certain parts of the body as the case may be;

It is the further object of the present invention to provide a foam patient support apparatus which is sufficiently durable to allow abuse of the apparatus by certain patients, yet sufficiently soft to prevent bed sores or the like from forming;

It is a further object of the present invention to provide a body support apparatus which is custom cut along an upper surface for contouring, in general, to the contours of a patient's body so that the patient has sufficient comfort and support during transport in emergency vehicle;

It is a further object of the present invention to provide a patient body support apparatus which has removable leg and arm portions which can simply be attached or detached from the principal body support portion, depending on the need;

It is a further object of the present invention to provide a patient body support apparatus which includes pockets or the like within the apparatus for inserting other types of units such as heating pads, gel packs, or certain types of bladders which would allow further care to the patient as the case may be;

It is a further object of the present invention to provide a lightweight yet firm and soft support apparatus for a patient which is relatively inexpensive, and can be transported quite easily within an emergency vehicle in an unassembled state and when assembled, provides significant support for the patient being transported in the vehicle.

BRIEF DESCRIPTION OF THE SEVERAL VIEW OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 7:
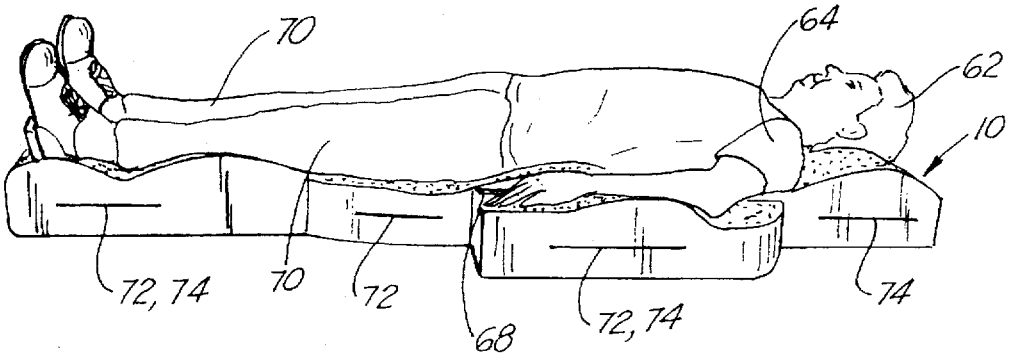
FIG. 7 is a side view thereof.
Figure 8:
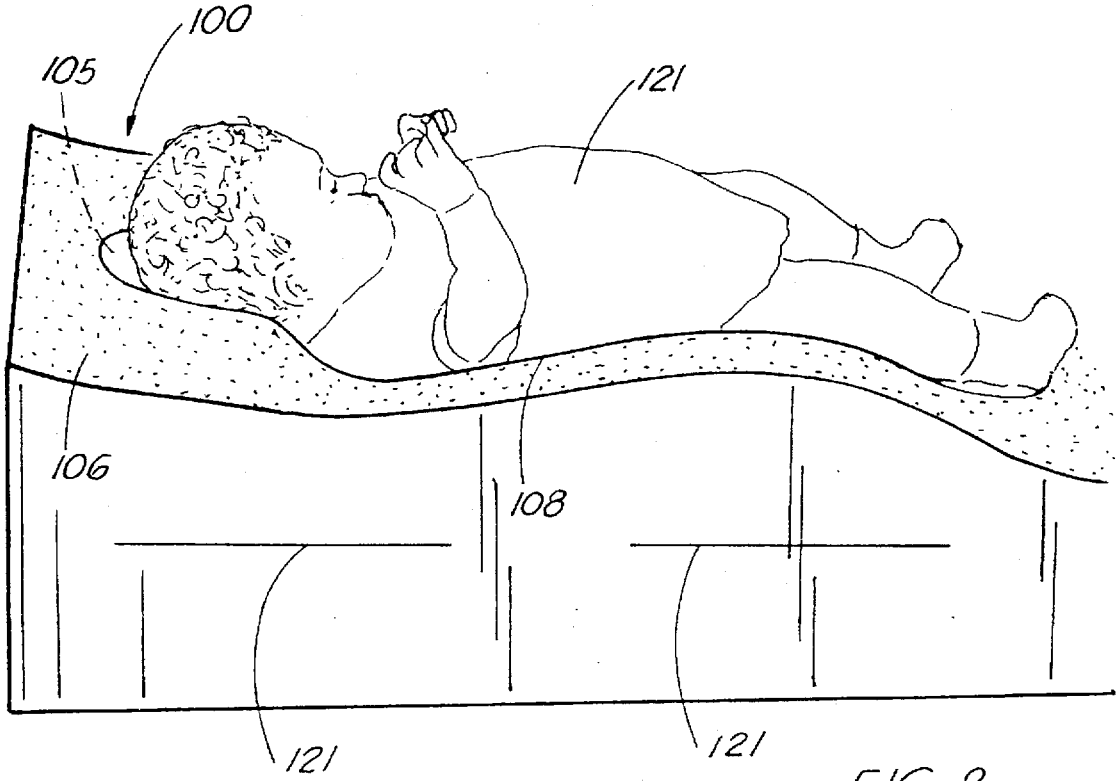
FIGS. 8 and 9 are side and front views of an additional embodiment of the apparatus of the present invention, with an infant supported therein.
Figure 9:
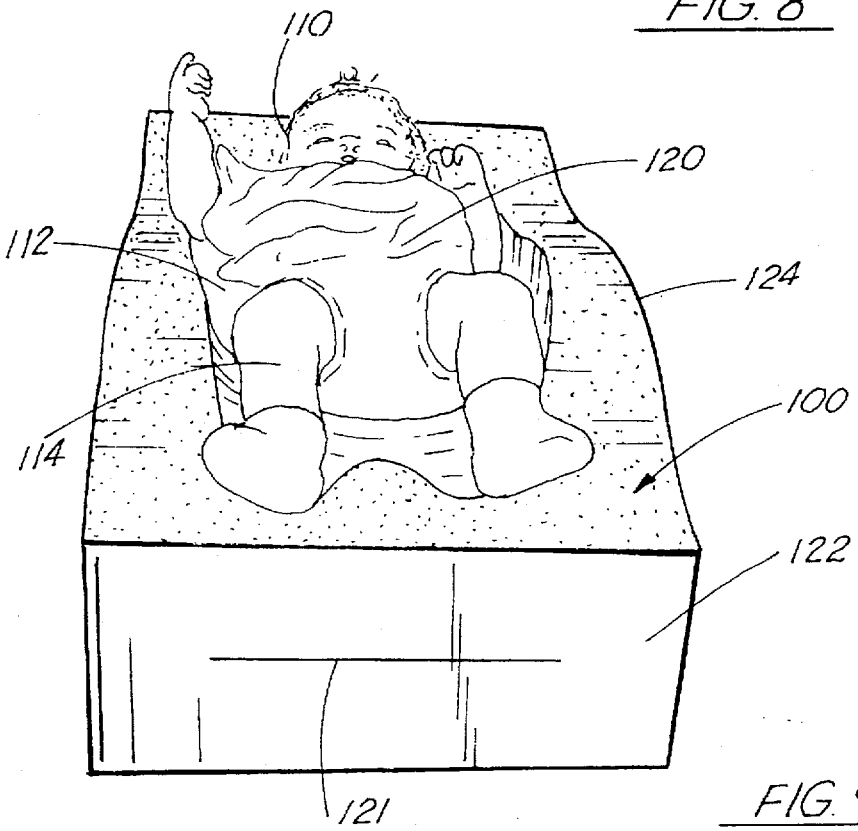
Figure 10:
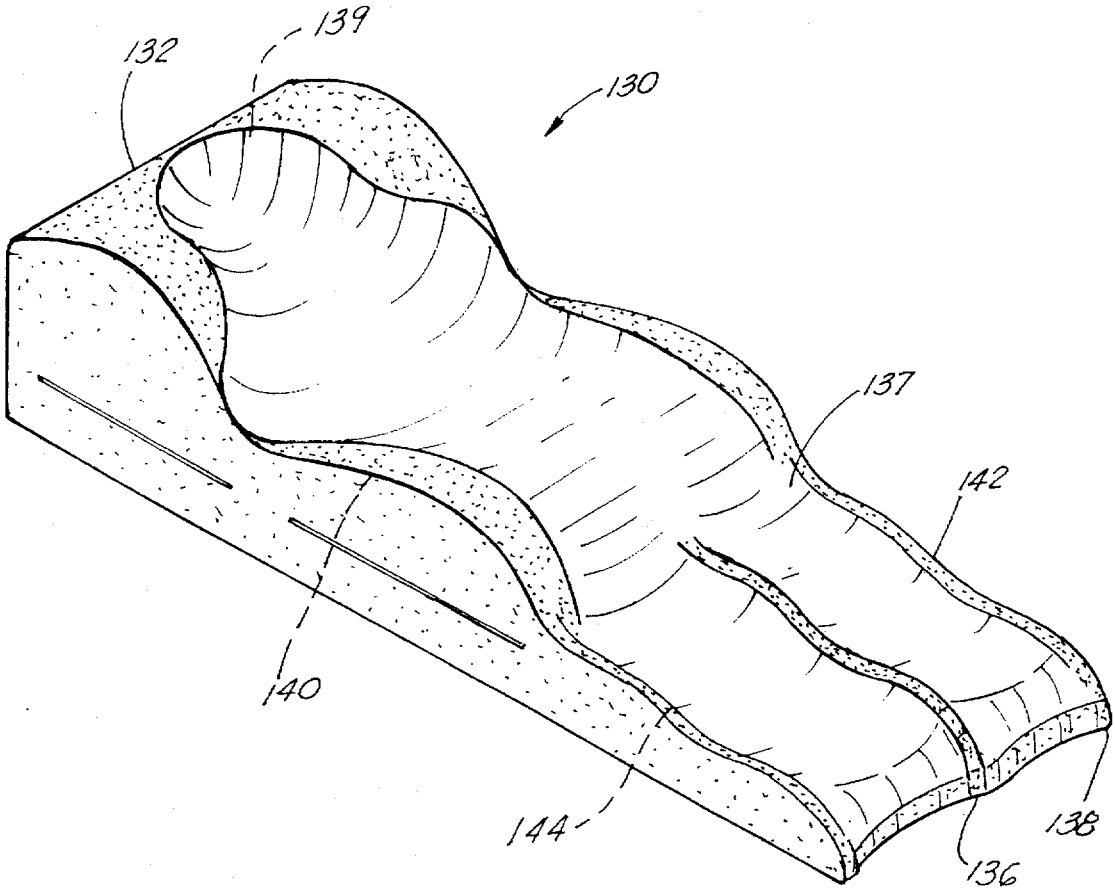
FIG. 10 illustrates an additional embodiment of the apparatus of the present invention.

FIGS. 1–8 illustrate the preferred embodiment of the apparatus of the present invention by the numeral 10, with FIGS. 9 and 10 illustrating an alternative embodiment of the present invention.

Figure 2:
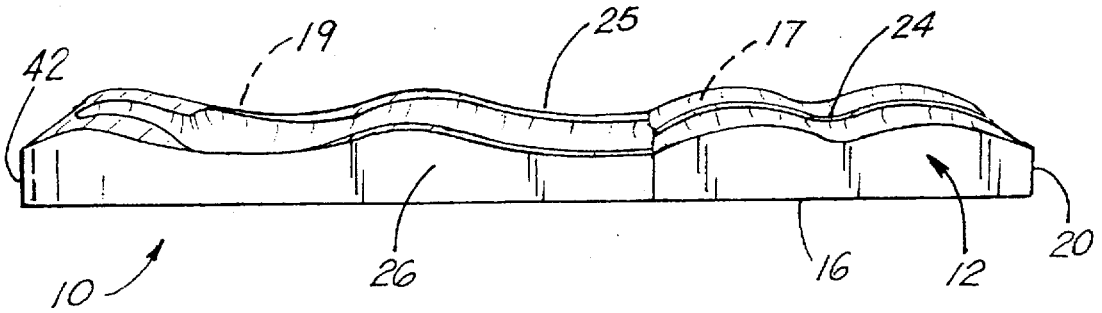
FIG. 2 is an overall side view of the preferred embodiment of the apparatus of the present invention.
Figure 1:
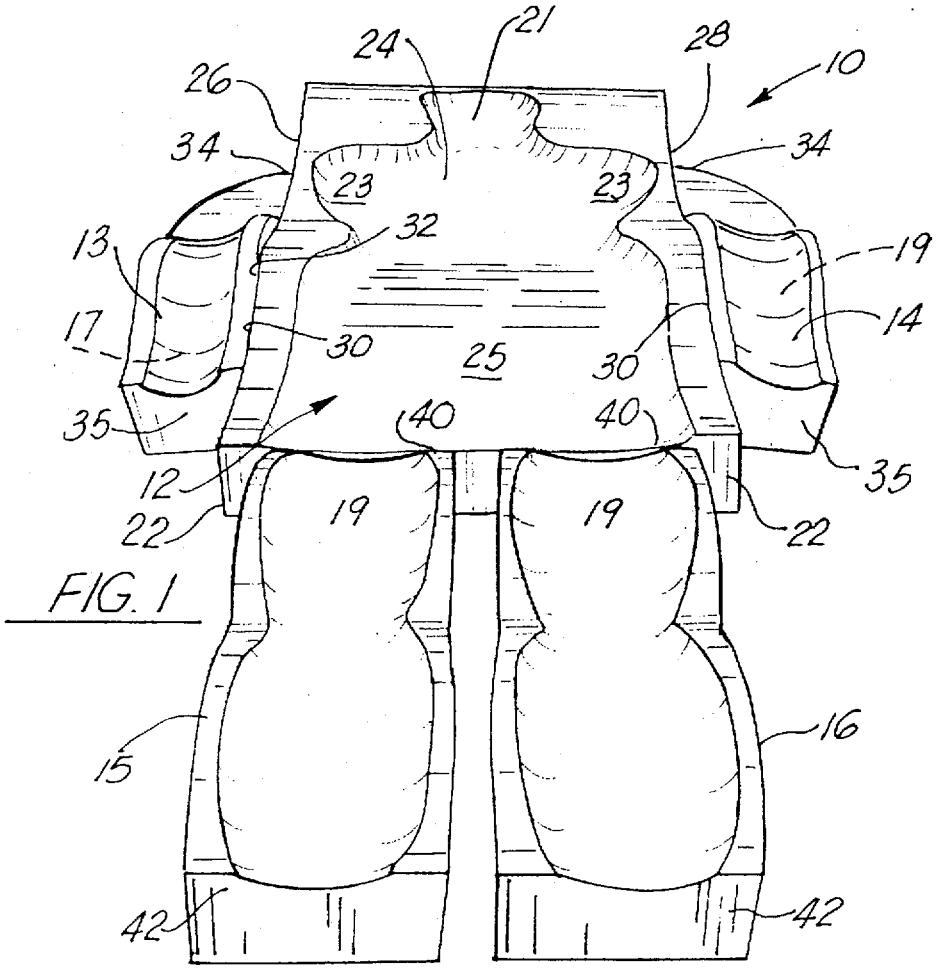
FIG. 1 is an overall view of the preferred embodiment of the apparatus of the present invention.

Turning now to FIGS. 1 and 2, the preferred embodiment of the present invention is labeled as apparatus 10. Apparatus 10 includes a principal body portion 12, arm portions 13, 14, and leg portions 15, 16. As illustrated in FIG. 1, all of the components, namely the body portion, leg portions and arm portions, of the preferred embodiment are constructed of a hard, firm yet soft supporting foam material, which is generally known in the art, and would allow in general a support for a patient lying thereupon, yet would allow support with comfort. As illustrated, the principal body portion 12 as seen in FIG. 1 and in side view in FIG. 2 includes a lower face 17, which is generally flat and would lie upon a hard flat surface 18 such as a stretcher in an ambulance or the like. As is illustrated, the body portion would further include a forward edge 20 and would terminate in a lower edge 22. The body portion would be substantially two to four inches in thickness along its entire length, with the length of the body portion 12 extending from first edge 20 just above the head portion of a patient to the lower edge 22 which would terminate generally at the lower portion of the buttocks of the patient. When a patient is laid upon the upper surface 24 of body portion 12, the patient would be supported from the top of his head to the lower portion of the buttocks on the principal body portion 12.

Further, as seen in FIGS. 1 and 2, as was stated earlier, there are illustrated arm portions 13, 14. Each of the arm portions 13, 14, would extend generally from the upper side walls 26, 28 of the body portion 12 and would include an inner edge 30 which would lie along the sidewalls 26, 28 of body portion 12, terminating at ends 35. For purposes of construction as seen more clearly in FIG. 2, there may be included a layer of hook and loop fastener material, sold under the trademark Velcro 32 along the entire edge 30 of arm portions 13, 14, so that when arm portions are placed in the position as seen in FIG. 2, the arm portions remain stabilized by the Velcro 32 along edges 30 and sidewalls 26, 28, of body portion 12. Therefore, there is no movement of arm portions 13,14, which may endanger the health and safety of a patient lying thereupon. Further, each of the arm portions 13 and 14 are secured at their upper most points 34 to the body portion 12 with an inner locking mechanism, which cannot be seen in FIGS. 1 and 2, but will be discussed further, as reference is made to additional FIGURES.

Turning now to the leg portions as is illustrated in FIGS. 1 and 2, leg portions 15,16 again have an upper edge 40, which meet the lower edge 22 of the body portion 12 and are secured thereto. Like the arm portions, the upper edge 40 of the leg portions 15, 16 care engaged with a locking feature which is shown in phantom view in FIG. 1, but again will be discussed more fully. The leg portions would simply extend downward along their entire length and would terminate at lower ends 42 so that when secured to the lower edge 22 of body portion 12, there would be defined an entire length of support for supporting the length of an average sized patient or the like. Also, as was described with arm portions 13, 14, each of the leg portions 15, 16 are secured along their upper edge 40 to the lower edge 22 of body portion 12 with Velcro so that even though locked in place by the locking feature, the legs would also be Velcroed to body portion 12.

Figure 3:
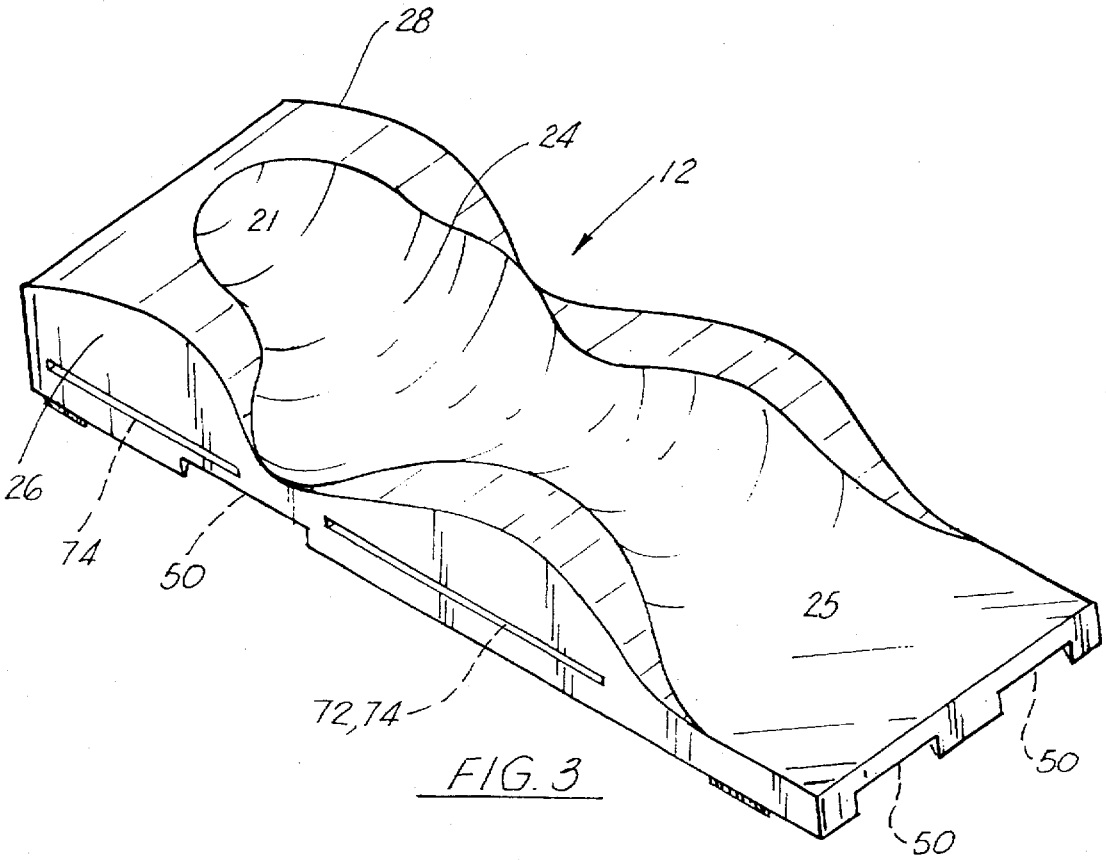
FIG. 3 is a partial side view of the torso portion of the apparatus of the present invention, illustrating the contours of the apparatus for a patient to be transported thereupon.

Turning now to a significant feature of the apparatus, again making reference to FIGS. 1 2, and 3 is the fact that the apparatus although having a flat lower face 17 as seen in FIG. 2 for being supported upon a surface 18 or the like, the upper face 24 of the body portion 12 has formed therein a contour means which is a recessed area which defines first a recessed head area 21, a shoulder area 22 recessed into the thickness of the foam material, and generally a center lumbar region 25 in the body portion. Likewise, each of the arms 13, 14 include a recessed area 17 along their length for defining the arms which would be set therein. Likewise, each of the leg portions 15, 16 would include a recessed area 19 which again would define an elongated recessed portion in which the thigh and calf portion of the legs of a patient would rest. As seen clearly in FIGS. 1 and 2, these recessed areas as explained earlier, would serve to fit the contour in general of an average patient and yet would allow the patient's upper torso arms and legs and head to be supported therein so that in comfort yet with minimal movement since the appendages in the body are resting in a recessed, contoured area.

Figure 4A:
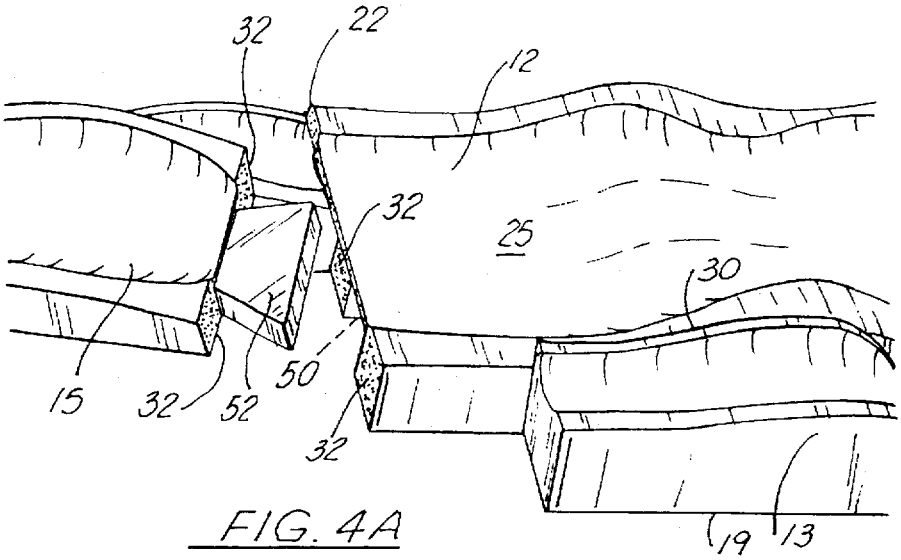
FIGS. 4A and 4B illustrate partial views of the preferred embodiment of the apparatus of the present invention, illustrating the attachment of a leg component thereupon.
Figure 5A:
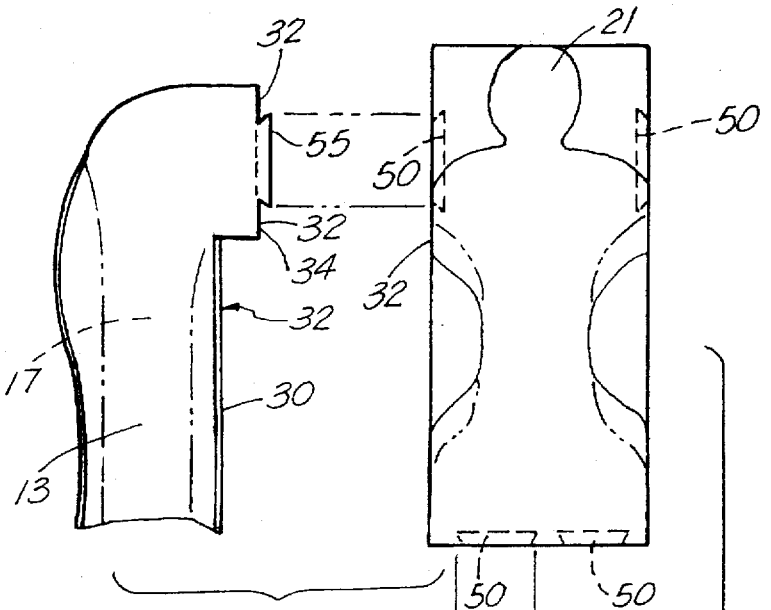
FIGS. 5A and 5B illustrate partial views of the preferred embodiment of the apparatus of the present invention illustrating the attachment of arm and leg components thereon.
Figure 5B:
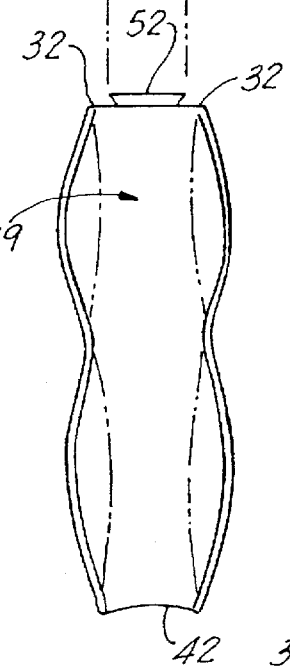
Figure 5B:
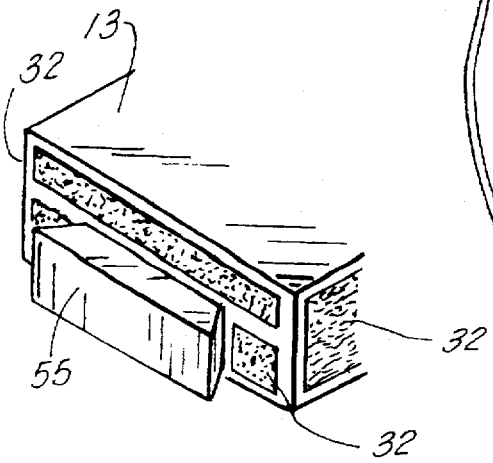

FIGS. 4 and 5 illustrate the means by which the leg portions 15, 16, and the arm portions 13, 14, are secured in place to the body portion 12. For example, in FIG. 4A, there is illustrated body portion 12 which again terminates in lower edge 22. As illustrated, the lower edge 22 would include a pair of openings 50 along the lower edge 22, each of the openings 50 which would be dovetail shaped, in order to receive a dovetail portion 52 formed on the upper edge 40 of each of the leg portions 15, 16. As illustrated in FIG. 4, the portion 52 extending from the upper edge 40 would fit into openings 50, and would be locked in place due to its dovetail shape, and once set in place as seen in FIG. 1, would be difficult to remove by a patient yet would be easily removed by a person working in the emergency room.

Likewise, as seen in FIG. 5A, the body portion further includes a pair of openings 50, one on each side wall 26, 28 of body portion 12, again each of the openings 50 formed in a dovetail shape for receiving a dovetail portion 55 which would be extending from each of the arm portions 13, 14. As illustrated in FIG. 5, the dovetail portion 55 would be forced into opening 50 and once in place, because of its dovetail shape, could not easily be removed by the movement of the patient but like with the leg portions, could easily be removed by a worker in the emergency room or in the emergency vehicle.

Figure 4B:
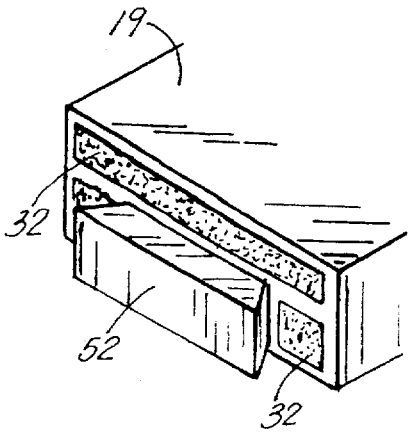

Further, as stated earlier, as illustrated in FIGS. 4B and 5B, in order to further accommodate the positioning of the leg portions 15, 16 and arm portions 13,14 in place against the body portion 12, there is included a layer of Velcro 32, for example, along the upper edge 40 of each of the leg portions 15, 16, which when the leg portion is in place as seen in FIG. 1, the Velcro would be secured to a second piece along the lower edge 22 of body portion 12 so that in addition to the dovetail interlocking as was described earlier, there would be a Velcroing of the leg portion 15, 16 to the body portion 12. This can be seen clearly in FIG. 4B. Also, reference is made to FIG. 5B, wherein in addition to the dovetail portion 55, being secured within openings 50, each of the arm portions along their inner edge 30 would include a strip of Velcro 32 extending generally from the upper shoulder region 34 to the lower end 35 of each of the arm members so that when the arm member is set in place as seen in FIG. 1, the length of Velcro between edges 30, and sidewalls 26, 28 would hold the arm members in place as seen in FIG. 1, so that any slight movement by the patient would be retarded yet the arm members could easily be removed from their position by a worker in the medical unit.

Figure 6:
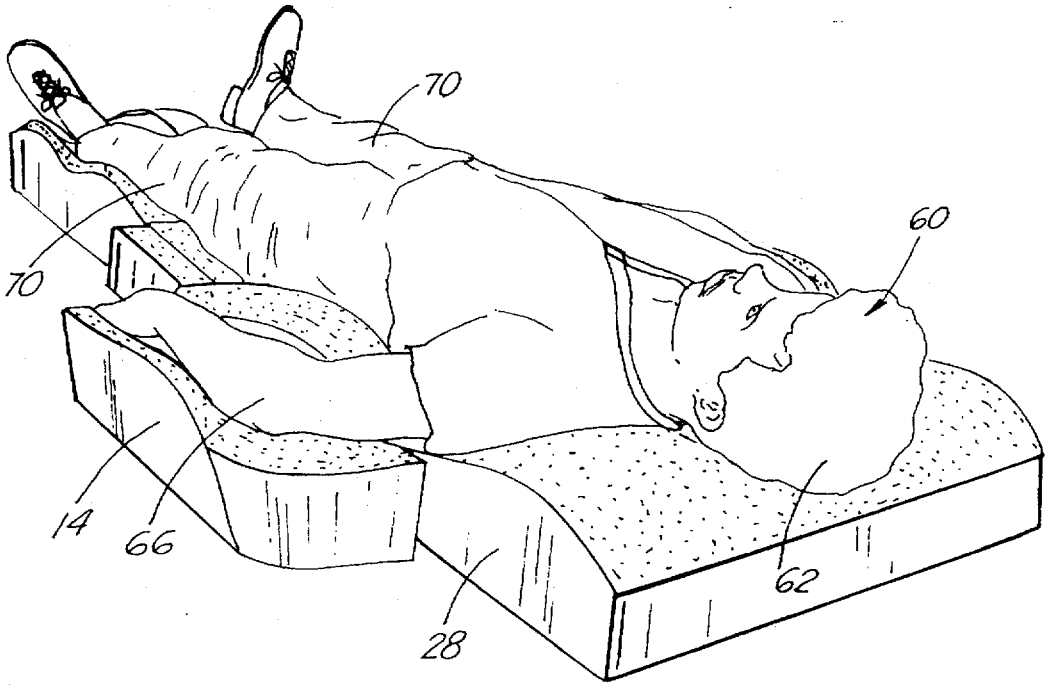
FIG. 6 is an overall view of the preferred embodiment of the apparatus supporting a patient thereupon.

The FIGS. 6 and 7 are included herewith to clearly illustrate the functioning of the apparatus when there is a patient lying thereupon. As seen in FIGS. 6 and 7, a patient 60 is laying prone on his back upon apparatus 1 of the type as seen in FIG. 1. As is noted, the head 62 of the patient rests easily within the recessed area 21 of the principal body portion, with the shoulders 64 of the patient resting in the contoured area 23 of the body portion 12. Likewise, each of the patient's arms 66 are laying at his side with the arms generally resting within the contour area 17 of each of the arm members 13, 14. Further, following down the patient's lower lumbar region 68 is resting within the recessed area 25 of the principal body portion 12, and each of the patient's legs 70 are resting within the contours 19 of the leg portions including the upper thigh and lower calve portion of the patient. In this position, it is noted, particularly in FIG. 7, because of the thickness of the apparatus 10 of the firm foam, the patient is firmly secured yet is resting comfortably.

For purposes of clarification, as seen in FIG. 7, there are openings 72 and 74 formed within the side edge 32 of the body portion 12. This particular feature is noted because the body portion 12 would incorporate pockets of sorts so that heating pads, gel packs or other types of treatment could be inserted into these pockets and provide additional types of relief to a patient lying thereupon. Such pockets 72, 74 could also be included on each of the arm portions 13, 14 and likewise each of the leg portions 15, 16. Furthermore, as illustrated in side view in FIG. 7, there may be included an inflatable pillow which could be incorporated into the head region 21 of the principal body support portion 12, so that when inflated would tend to lift the head of the patient. Furthermore, there could be an inflatable head portion which when inflated could provide an inflatable support at each side of the patient's head for maintaining the patient's head in a relatively straight forward position and would not allow the patient's head to turn back and forth, should there by any potential neck injury or the like which is being addressed, either during transport or initial resting of the patient therein.

In the preferred embodiment, it is foreseen that the apparatus would be useful in many settings. For example, because of the lightweight material and the fact that the apparatus is a assembleable into a principal body portion, leg portions, and arm portions, it could be easily stored away, for example, in en emergency transport vehicle, and easily assembled on site should the case call for it. Furthermore, because of the fact that the apparatus is constructed of one-piece foam for the body portion, it is foreseen that it would be very durable and able to withstand much transport and even abuse by a patient. The assembling of the apparatus as noted earlier is quite simple, and therefore would be easy to assemble and disassemble on very short notice.

Reference is now made to FIGS. 8 and 9 which illustrate an additional embodiment of the apparatus of the present invention. The only difference between this embodiment and the principal embodiment is the fact that this modified apparatus labeled as 100 illustrates a support apparatus which is in a single piece, and is particularly suitable for a small child or infant. Because of the very short length of a child or infant's body, one could foresee that a single piece of foam 102, could be formed having a lower surface 104 for resting on a bed or the like, and an upper surface 106 which would have a contour 108 formed along its upper surface 106, the contour which would generally be shaped like a baby's body, that is having a head portion 110, a generally upper torso portion 112, and a pair of leg portions 114, so that an infant or baby 120 could be laid within the contoured area and would be maintained flat on its back during transport, yet would be restricted in its movement and would be relatively comfortable and ultimately safe while being transported. Again, like with the principal embodiment, the body portion may include a series of pockets 121 along its lower edge 122 or its side edges 124 so that other types of treatment such as heating pads or gel packs could be placed therein for providing further treatment to an infant supported in the apparatus 100.

FIG. 10 illustrates yet an additional embodiment of the invention. As illustrated, the embodiment illustrates an apparatus 130, which extends from an upper edge 132, at the head portion, to the lower end 136, which would terminate at point 138, which would be at the knee of the average person, defining the body portion 137. The apparatus 130 would have the same contours as the preferred embodiment, with a contoured head area 139, extending into a contoured torso area 140, and terminating in a pair of contoured thigh areas 142, 144. The principal difference in this embodiment is the fact that there is no lower leg portions, no arm portions, and the width of the body portion 137 would be sufficiently narrow to fit upon an ambulence gurney, for transporting a patient on such a narrow surface, but, secured firmly within the contoured apparatus 130. For purposes of further securement, the contoured head portion 139 may be slightly deeper, so that the head of the patient is encased within the contour to reduce unwanted movement.

PARTS LIST

The following is a list of suitable parts and materials for the various elements of the preferred embodiment of the present invention.

PARTS LIST

| description | part no. |
|---|---|
| apparatus | 10 |
| body portion | 12 |
| arm portions | 13, 14 |
| leg portions | 15, 16 |
| lower face | 17 |
| recessed area | 17, 19 |
| flat surface | 18 |
| forward edge | 20 |
| head area | 21 |
| lower edge | 22 |
| shoulder area | 23 |
| upper surface | 24 |
| lumbar region | 25 |
| side walls | 26, 28 |
| edge | 30 |
| Velcro | 32 |
| points | 34 |
| ends | 35 |
| upper edge | 40 |
| lower ends | 42 |
| openings | 50 |
| dovetail portion | 52 |
| upper edge | 53 |
| dovetail portion | 55 |
| patient | 60 |
| head | 62 |
| shoulder | 64 |
| arms | 66 |
| lumbar region | 68 |
| legs | 70 |
| openings | 72, 74 |
| apparatus | 100 |
| foam | 102 |

-continued

PARTS LIST

| description | part no. |
|---|---|
| lower surface | 104 |
| upper surface | 106 |
| contour | 108 |
| head portion | 110 |
| torso portion | 112 |
| leg portions | 114 |
| infant | 120 |
| pockets | 121 |
| lower edge | 122 |
| side edges | 124 |
| apparatus | 130 |
| upper edge | 132 |
| lower end | 136 |
| point | 138 |
| body portion | 137 |
| contoured head area | 139 |
| contoured torso area | 140 |
| contoured thigh areas | 142, 144 |

The foregoing embodiments are presented by way of example only; the scope of the present invention is to be limited only by the following claims.

We claim:

1. A patient support apparatus, formed of foam material, comprising:

a. a principal body portion having a lower face for resting on a generally flat surface, and an upper face for supporting the upper torso of a patient lying thereupon;

b. a pair of leg members securable to the body portion for supporting the legs of a patient;

c. a pair of arm members securable to the body portion for supporting the arms of the patient; and, d. contoured regions formed in the upper body portion, leg members and arm members which generally conform to the shape of a person, for supporting the patient comfortably, yet securely on the support apparatus.

2. The apparatus in claim 1, further comprising interlocking members for engaging each the arm and leg members to the upper body portion.

3. The apparatus in claim 1, further comprising openings formed in the upper body portion for accommodating a heating pad, gel pack, or other item in order to provide further treatment to the patient.

4. The apparatus in claim 1, further comprising hook and loop fastener material along an edge of each of the arm members for engagement to an edge of the body portion for maintaining each arm member secured to the body portion substantially along their entire length.

5. The apparatus in claim 1, further comprising hook and loop fastener material along an upper edge of each of the leg members for engagement to a lower edge of the body portion for maintaining said leg member secured to the body portion substantially at the contact point between the leg members and the body portion.

6. The apparatus in claim 1, wherein the body portion, arm members and leg members are constructed of firm, soft foam material.

7. The apparatus in claim 1, wherein the body portion further includes a head portion contoured to receive the head of a patient there within.

8. A patient support apparatus, to support a patient in the prone position, comprising:

a. a principal body portion having a lower face for resting on a generally flat surface, side edges, a top region, a lower edge, and an upper face for supporting the upper torso of a patient lying thereupon;

b. a pair of leg members securable to the lower edge of the body portion for supporting the legs of a patient;

c. a pair of arm members securable to each side edge of the body portion for supporting the arms of the patient; and, d. contoured regions formed in the upper body portion, leg members and arm members which generally conform to the shape of a person, for supporting the patients comfortably, yet securely on the support apparatus.

9. The apparatus in claim 8, further comprising interlocking members for engaging each the arm and leg members to the upper body portion, each of the locking members further defining a dovetail locking arrangement for maintaining the arms and leg members secured to the body portion.

10. The apparatus in claim 8, further comprising openings formed in the upper body portion for accommodating a heating pad, gel pack, or other item in order to provide further treatment to the patient.

11. The apparatus in claim 8, further comprising hook and loop fastener material along an edge of each of the arm members for engagement to the side edges of the body portion for maintaining each arm member secured to the body portion substantially along their entire length.

12. The apparatus in claim 8, further comprising hook and loop fastener material along the upper edge of each of the leg members for engagement to the lower edge of the body portion for maintaining said leg member secured to the body portion substantially at the contact point between the leg members and the body portion.

13. The apparatus in claim 8, wherein the body portion, arm members and leg members are constructed of firm, soft foam material.

14. The apparatus in claim 8, wherein the body portion further includes a head portion contoured to receive the head of a patient there within.

15. A patient support apparatus, to support a patient in the prone position, comprising:

a. a principal body portion having a lower face for resting on a generally flat surface, side edges, a top region, a lower edge, and an upper face for supporting the upper torso of a patient lying thereupon;

b. a pair of leg members securable to the lower edge of the body portion for supporting the legs of a patient;

c. a pair of arm members securable to each side edge of the body portion for supporting the arms of the patient;

d. contoured regions formed in the upper body portion, leg members and arm members which generally conform to the shape of a person, for supporting the patients comfortably, yet securely on the support apparatus; and e. interlocking members for engaging each the arm and leg members to the upper body portion, each of the locking members further defining a dovetail locking arrangement for maintaining the arms and leg members secured to the body portion.

* * * * *